United States Patent [19]

Rutkiewic et al.

[11] 4,446,044

[45] May 1, 1984

[54] AQUEOUS WATER-IN-OIL CLEANING EMULSION

[75] Inventors: Andrew F. Rutkiewic, West Chester, Pa.; James P. White, Pensauken, N.J.

[73] Assignee: E. I. Du Pont de Nemours and Company, Wilmington, Del.

[21] Appl. No.: 376,232

[22] Filed: May 7, 1982

Related U.S. Application Data

[63] Continuation-in-part of Ser. No. 252,573, Apr. 9, 1981, abandoned, which is a continuation-in-part of Ser. No. 208,421, Nov. 19, 1980, abandoned.

[51] Int. Cl.[3] ..... C11D 1/72; C11D 3/43; C11D 17/08; C23G 5/02

[52] U.S. Cl. ..... 252/170; 252/174.21; 252/174.22; 252/309; 252/DIG. 1; 252/DIG. 14

[58] Field of Search ..... 252/309, DIG. 1, DIG. 14, 252/170, 174.21, 174.22, 174.31

[56] References Cited

U.S. PATENT DOCUMENTS

| | | | |
|---|---|---|---|
| 2,948,686 | 8/1960 | Gianladis | 252/153 |
| 3,311,561 | 3/1967 | Anderson et al. | 252/309 X |
| 3,538,007 | 11/1970 | Cooper et al. | 252/144 |
| 3,751,970 | 8/1973 | Alburger et al. | 73/36 |
| 4,302,365 | 11/1981 | Holmgren et al. | 252/170 X |
| 4,370,174 | 1/1983 | Braithwaite | 252/167 X |

FOREIGN PATENT DOCUMENTS

| | | |
|---|---|---|
| 1067685 | 11/1979 | Canada . |
| 7608911 | 2/1977 | Netherlands . |
| 1553212 | 9/1979 | United Kingdom . |

OTHER PUBLICATIONS

Nonionic Surfactants–Martin J. Schick, Marcel Dekkel Inc., New York 1967.

*Primary Examiner*—John E. Kittle
*Assistant Examiner*—Mukund J. Shah

[57] ABSTRACT

A water-in-oil emulsion stabilized with a blend of selected nonionic surfactants and having a preferred weight ratio of aqueous dispersed phase to continuous organic solvent phase between about 3:1 and 8:1 is provided.

The emulsion is characterized by superior cleaning properties and particularly by the capability of removing both water-soluble and solvent-soluble materials from automotive finishes.

5 Claims, No Drawings

AQUEOUS WATER-IN-OIL CLEANING EMULSION

CROSS REFERENCE TO RELATED APPLICATIONS

This application is a continuation-in-part of application Ser. No. 252,573, filed Apr. 9, 1981, now abandoned which is a continuation-in-part of application Ser. No. 208,421, filed Nov. 19, 1980, now abandoned.

BACKGROUND OF THE INVENTION

This invention relates to aqueous cleaning compositions and, more specifically, to aqueous compositions which possess great utility in connection with the cleaning of automotive finish surfaces. While the surface to be cleaned will ordinarily be composed of a polymeric material, e.g., the type of material used for primer, intermediate, or final coats, the novel composition of this invention will also clean bare metal surfaces. It is anticipated that the invention will be particularly valuable for use in automobile refinish shops, i.e., for cleaning an automobile or other vehicle prior to repair and/or repainting.

Automobile refinish shops have for many years utilized special cleaning fluids formulated to remove residual wax, tar, sanding dust, and overall grime from the surfaces upon which work is being performed. Although such cleaning fluids have proven to be effective for most types of residue, they have the distinct disadvantage of being composed predominantly of organic solvents. In an era of increasingly stringent solvent emission regulations, solvent-based cleaners present a potential problem. It is estimated that approximately forty percent of the effluent in refinish shops is due not to the paint itself, but rather to the cleaning fluid employed. Conventional solvent-based cleaning fluids have the additional disadvantage of being unable to readily remove water-soluble dirt, e.g., tree sap and bird droppings, from automotive surfaces.

For the aforementioned reasons, there exists a felt need for a cleaning fluid which not only will facilitate compliance with both current and proposed air pollution standards, but also will remove both solvent-soluble and water-soluble dirt from automotive surfaces.

SUMMARY OF THE INVENTION

There is provided by the present invention a water-in-oil emulsion which possesses excellent cleaning properties and is effective in removing both water-soluble and oil- or solvent-soluble materials. The emulsion consists essentially of (1) an internal, or dispersed, phase of 70–85 percent by weight of water;

(2) an external, or continuous, oil phase of 10–25 percent by weight of a blend of aromatic organic solvents or aromatic and aliphatic organic solvents having a solvency parameter with a dispersion component value of 7.70–8.80, a polar component value of 0–0.70, and a hydrogen bonding component value of 0.005–1.42; and (3) 1.5–7.5 percent by weight of at least one hydrophobic nonionic surfactant having an HLB value less than 3; and (4) 1.5–7.5 percent by weight of at least one hydrophilic nonionic surfactant having an HLB value greater than 10 and soluble in solvent blends having a solvency parameter with a polar component value less than 0.9 or a hydrogen bonding component value less than 1.

DETAILED DESCRIPTION OF THE INVENTION

The essence of the present invention lies in the discovery that a superior cleaning composition can be produced by emulsifying a major amount of water into a minor amount of organic solvent such that the water forms the internal, or dispersed, phase of the emulsion rather than the external, or continuous, phase. The emulsion possesses the following advantageous characteristics:

(1) The emulsion has excellent stability, being stabilized by a blend of carefully selected nonionic surfactants which serve both as emulsifiers and as cleaning agents.

(2) The emulsion is a pourable liquid rather than an unmanageable, nonpourable paste or gel.

(3) The emulsion represents a marked improvement over conventional solvent-based cleaners in that it enables compliance with increasingly stringent solvent emission regulations and is capable of removing both water-soluble and solvent-soluble materials.

The major component of the emulsion of the present invention is water. The emulsion contains at least 70 percent by weight of water, preferably 72–78 percent. There are a number of advantages to substituting water for those organic solvents which ordinarily constitute the bulk of a cleaning fluid. Because water is noninflammable, odorless, and nontoxic, large quantities of water are more easily handled than like quantities of most organic solvents. Replacing organic solvents with water will, of course, decrease the solvent emission level and thereby reduce the concomitant air pollution. Still another advantage, and an important commercial consideration, is water's nominal cost and ready availability.

The emulsion of this invention is a water-in-oil emulsion, wherein the water phase is dispersed as small globules in an oil, or solvent, phase. More specifically, 70–85 percent by weight of water is dispersed in 10–25 percent by weight of oil. The emulsion contains 3–15 percent by weight of a blend of two or more nonionic surfactants, which serve to emulsify and stabilize.

The oil is a blend of aromatic organic solvents or aromatic and aliphatic organic solvents, selected on the basis of its solvency parameter. Solvency parameters are well known in the art and are explained in considerable detail in an article by C. Hansen and A. Beerbower entitled "Solubility Parameters", Kirk-Othmer Ency. Chem. Tech., 2d Ed. 1971, *Interscience*, pp. 889–910, hereby incorporated by reference.

The solvent blend should be characterized by a solvency parameter having parameter component values which fall within the following ranges:

(1) from 7.70 to 8.80 for the dispersion component ($\delta_D$);

(2) from 0 to 0.70 for the polar component ($\delta_P$); and (3) from 0.005 to 1.42 for the hydrogen bonding component ($\delta_H$).

Examples of solvent blends possessing the requisite solvency parameter include, for example, 50:50 weight ratio blends of toluene and V.M. & P. naphtha, of xylol and certain aliphatic or automatic hydrocarbons, and of aromatic controlled mineral spirits and certain aliphatic hydrocarbon solvents. Other possibilities will be readily apparent to those having familiarity with solubility parameters and their application. It is anticipated that specific blends will be tailored to satisfy specific requirements; e.g., ease of emulsification may be desirable in order to satisfy time or equipment constraints, or higher flash points may become necessary in order to satisfy more stringent shipping regulations.

The ratio between the internal, or dispersed, phase of an emulsion and the external, or continuous, phase is referred to as the phase-volume ratio. If the phase-volume ratio is near 50:50, there will be no preference for the formation of either an oil-in-water or a water-in-oil emulsion. The type of emulsion that is eventually formed will depend upon the choice of emulsifying agent, the chemical properties of the constituents, and the order of incorporation.

If, on the other hand, one phase is considerably in excess, there is a strong probability that the phase in excess will become the external phase. Special precautions must be taken if the phase in excess is intended to be, instead, the internal phase of the emulsion. Such is the case with the present invention, wherein the preferred weight ratio of water to organic solvent is between 3:1 and 8:1. In order for this particular emulsion to be efficacious as a cleaner, it is necessary that the water, not the organic solvent, constitute the internal phase. For this reason, the choice of solvents and surfactants, their respective ratios, and the process by which the emulsion is formed are important.

Surfactants, or emulsifying agents, serve to produce relatively stable mixtures of immiscible liquids by reducing interfacial tension. Unless the proper type, and quantity, of surfactant is incorporated into the emulsion of the present invention, the water droplets will have a strong tendency to reunite in order to decrease the free surface. The combination of nonionic surfactants employed in the present invention drastically lowers this strong interfacial tension, and thus, the tendency of the water droplets to flow together. The molecules of surfactant orient themselves at the interface of the water and the organic solvent blend and produce an interfacial film which protects the water droplets. The result is a water-in-oil emulsion of unusual and unexpected stability.

The emulsion of the present invention contains at least one hydrophobic nonionic surfactant having a hydrophile-lipophile balance (HLB) value less than 3. Although this hydrophobic surfactant may be used alone, to produce a stable water-in-oil emulsion with excellent cleaning ability, it is often desirable to use it in conjunction with a second surfactant of hydrophilic character. The preferred combination of hydrophobic and hydrophilic surfactants employed in the present invention imparts exceptional stability to the resultant emulsion, such that the emulsion can be subjected to fairly drastic temperature changes without losing its water-in-oil stability. Although phase separation, or even complete destabilization of the emulsion, may result from such temperature changes, homogeneity is readily restored by shaking. However, it is to be understood throughout the discussion herein that, where such exceptional stability is not required, the hydrophobic surfactant alone may be substituted for the hydrophobic-hydrophilic blend.

The hydrophilic surfactant must have an HLB value greater than 10, and must also be soluble in solvent blends having a solvency parameter with either a polar component value less than 0.9 or a hydrogen bonding component value less than 1. Solvent blends having such parameters are conventionally used in automotive coating compositions. Because the emulsion of the present invention has particular utility as a cleaner for automotive refinish purposes, it must in no way interfere with intercoat adhesion, i.e., the ability of the subsequently-applied coat of paint to adhere to the newly-cleaned surface. Upon evaporation of the solvent and water components of the emulsion, surfactant will be left behind on the vehicle surface. As the surface is painted, the hydrophobic portion of the surfactant blend will readily dissolve into the paint solvent. The hydrophilic surfactant must also be soluble in this paint solvent, to preclude its remaining as a film on the surface and interfering with intercoat adhesion. It should be noted that, although the insertion of an additional washing step between the cleaning and painting steps would alleviate the problem of surfactant interference, such a step would be commercially impractical. At present, refinish practice requires no washing step, as the current solvent-based cleaners quickly volatilize. The necessity of adding a costly, labor-intensive extra step would undoubtedly be looked upon unfavorably by refinish shops.

Preferred hydrophobic surfactants belong to the class of poly(oxyethylene)-poly(oxypropylene) block copolymers having the general formula $$HO-(CH_2-CH_2-O)_a\left(\underset{\substack{|\\ CH_3}}{CH}-CH_2-O\right)_b(CH_2-CH_2-O)_cH$$

wherein a, b, and c are integers and the molecular weight of the poly(oxypropylene) content is between 2750 and 4000. These copolymers are available commercially from BASF Wyandotte Corporation under the trade name Pluronic®.

One particularly preferred hydrophobic block copolymer surfactant has the chemical formula $HO(CH_2CH_2O)_7(CH_3CHCH_2O)_{54}(CH_2CH_2O)_7H$. Its hydrophobic character is a function of the predominance of the hydrophobic poly(oxypropylene) base over the hydrophilic poly(oxyethylene) groups. The weight ratio of poly(oxypropylene) to poly(oxyethylene) in this surfactant is approximately 9:1.

Preferred as hydrophilic surfactants are polyoxyethylated nonylphenols of the formula

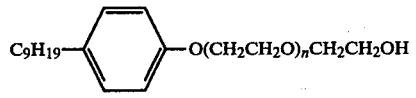

wherein n is a positive integer. These surfactants are available commercially from GAF Corporation under the trade name Igepal® CO.

One particularly preferred polyoxyethylated nonylphenol surfactant has the formula

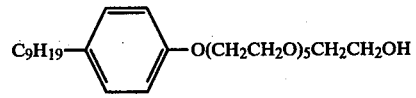

and comprises about 54 percent by weight of hydrophilic ethylene oxide.

An effective automotive cleaning fluid is produced by combining 70–85 percent by weight of water, 10–25 percent by weight of a blend of aromatic and aliphatic organic solvents having a solvency parameter with component values falling within the aforementioned ranges, 1.5–7.5 percent by weight of a hydrophobic nonionic surfactant having an HLB value less than 3, and 1.5–7.5 percent of a hydrophilic nonionic surfactant having both an HLB value greater than 10 and appropriate solubility. One particularly recommended formulation consists essentially of 75–79 percent by weight of water, 15–17 percent by weight of a 50:50 weight ratio blend of toluene and V.M. & P. naphtha, 1.5–7.5 percent by weight of a poly(oxyethylene)-poly(oxypropylene) block copolymer hydrophobic surfactant, and 1.5–7.5 percent by weight of a polyoxyethylated nonylphenol hydrophilic surfactant. Another particularly recommended formulation consists essentially of 75–79 percent by weight of water; 15–17 percent by weight of a 68:8:8:8:8 weight ratio blend of aromatic hydrocarbon, V.M. & P. naphtha, mineral spirits, heavy mineral spirits, and xylol, 1.5–7.5 percent by weight of a poly(oxyethylene)-poly(oxypropylene) block copolymer hydrophobic surfactant, and 1.5–7.5 percent by weight of a polyoxyethylated nonylphenol hydrophilic surfactant. The latter formulation is characterized by a substantially higher flash point than is the 50:50 weight ratio blend of toluene and V.M. & P. naphtha, thus enabling compliance with shipping regulations requiring a "combustible" rather than "flammable" classification.

The stability of an emulsion is affected by many parameters. In addition to the choice of surfactant(s) and the concentration of the various components, process considerations, e.g., the mixing equipment, the sequence in which the ingredients are added, the speed and duration of the process, and temperature changes, are of great importance.

Ideally, an automotive cleaning emulsion will remain stable and retain its cleaning power under all conditions, including drastic temperature changes, will in no way interfere with the adhesion of substances, such as paint or wax, which are subsequently applied to the cleaned surface, and will easily remove all types of dirt and other unwanted substances. No one formulation will be optimal in all of these properties. The composition of the emulsion of the present invention can be varied depending upon the particular purpose to which it is to be put and the properties required for such purpose. A surfactant blend containing more hydrophobic surfactant and less hydrophilic surfactant will promote better intercoat adhesion, for example, whereas a blend containing more hydrophilic surfactant will yield improved stability.

Preferably, both the aqueous phase and the oil phase are prepared in advance. The oil phase is prepared by dissolving the hydrophobic surfactant in the solvent blend by simple agitation, and the hydrophilic surfactant is similarly introduced into the water to form the aqueous phase.

After both phases are properly prepared, the mechanical operation of emulsification begins. The oil or solvent phase is vigorously agitated, and the water phase is gradually introduced. It is important that the vigorous agitation be constant, without interruption, while all of the water is being added, in order that the internal phase of the emulsion be disintegrated into particles as small as possible. Initially, the solvent blend will be in excess, and stability conditions will be favorable. As more and more water is added, there exists the danger that the emulsion will be forced in the wrong direction, i.e., into an oil-in-water emulsion rather than a water-in-oil emulsion, since under the circumstances such an emulsion would require much less work of emulsion and would possess greater stability. For this reason, agitation must continue beyond the time at which the last portion of water phase is added to the nascent emulsion. This additional time allows the surfactant molecules to accumulate at the interface of the phases, to assume oriented positions, and to form the interfacial firm which protects the water droplets.

The time required for emulsification is dependent upon the mixing apparatus as well as the specific characteristics desired of the resultant cleaner. A common type of mixing operation, and one adequately suited for use in the present invention, involves one or more propellers mounted on a common shaft in a mixing tank. Propeller agitation is satisfactory for low and medium viscosity emulsions, and it is anticipated that the emulsion of the present invention will be most useful if of low enough viscosity to be a pourable liquid. A shorter mix time and a lower mixing speed yield emulsions of lower viscosity, while higher viscosity emulsions are the result of longer mix times at higher speeds. Other conventional mixing methods may also be employed.

This invention is illustrated but not limited by the following example in which all parts are by weight:

EXAMPLE

Toluene (63 parts), V.M. & P. naphtha (63 parts), and a poly(oxyethylene)-poly(oxypropylene) block copolymer having the formula $HO(CH_2CH_2O)_7(CH_3CHCH_2O)_{54}(CH_2CH_2O)_7H$ (24 parts) are combined and mixed until blended, about 5 minutes. A polyoxyethylated nonylphenol having the formula

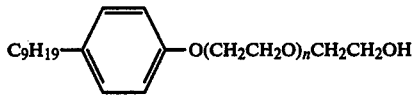

(36 parts) is added to water (603 parts) and the mixture is stirred until the copolymer is thoroughly dissolved, about 20 minutes. The aqueous portion is added gradually, with mixing, to the solvent portion. This addition is performed in about 25 minutes, following which the resultant emulsion is mixed for an additional 5 to 10 minutes.

The emulsion so prepared has a viscosity of about 14 poise, as measured with a Brookfield LVT #3 spindle at 12 r.p.m., and is a pourable fluid. The viscosity of the emulsion is dependent upon many factors, including the mix time, the mixing speed, and the type of mix blade. By varying one or more of these factors, a person of ordinary skill in the art can arrive at the particular viscosity desired for a specific use or circumstance.

The emulsion is applied to a dry cloth and tested for cleaning power using standard procedures. A waxed automotive panel is rubbed with the emulsion-containing cloth and allowed to dry. The panel is then swabbed with a cotton swab which has been soaked with hexylene glycol. The surface tension of a waxed finish is about 26 dynes/cm, whereas the surface tension of an unwaxed finish is about 35 dynes/cm. Hexylene glycol, having a surface tension of about 29 dynes/cm, is a useful indicator of wax removal, as it will wet a wax-free surface but will not wet a waxed surface. This test reveals that all the wax has been removed from the panel by the cleaning emulsion, because the hexylene glycol stays in contact with the panel with no visible crawling or creeping.

Next, an automotive panel is coated with stripes of road tar. Holes are punched in strips of masking tape and placed over the tar stripes. A few drops of emulsion are placed in each hole, allowed to stand for several minutes, and dabbed off with paper towels. No tar remains beneath the holes. Panels containing various other substances commonly encountered on automotive panels, e.g., mud, standing dust, bird and insect excrement, and tree sap, are cleaned with the emulsion. In each instance, the substance is totally removed.

Freeze/thaw and oven stability tests are conducted to determine the emulsion's capacity for remaining stable upon undergoing severe temperature change. Samples of the emulsion are placed in an oven and kept at 120° F. for eleven days. When removed on the twelfth day, the emulsion has the same appearance and cleaning ability as another sample which has undergone no temperature change. Next, samples of emulsion are frozen, thawed, frozen a second time, and again thawed. Although some separation occurs, shaking reconstitutes the water-in-oil emulsion, and its cleaning power is unhampered.

Finally, intercoat adhesion tape tests are conducted to ascertain that use of the cleaning emulsion will not interfere with the adhesive capabilities of the cleaned surface. An automotive panel is first cleaned with the emulsion and allowed to dry. The panel is then sprayed with conventional automotive paint and air dried. There is no additional washing step between the cleaning of the panel and its painting. The dried panel is then scored, with "X"-shaped cuts extending completely through the newly-applied topcoat. Strips of masking tape are affixed to the panel, over the cuts, and are pulled. The painted surface remains virtually intact, indicating that use of the emulsion will not interfere with intercoat adhesion.

The pourable consistency of the cleaning emulsion is conducive to easy application by conventional techniques.

What is claimed is:

1. A cleaning composition of a water-in-oil emulsion consisting essentially of:

(a) a dispersed phase of 70–85 percent by weight, based on the weight of the emulsion, of water;

(b) a continuous phase of 10–25 percent by weight, based on the weight of the emulsion, of oil, wherein said oil is a blend of aromatic organic solvents or aromatic and aliphatic organic solvents having a solvency parameter with a dispersion component value of 7.70–8.80, a polar component value of 0–0.70, and a hydrogen bonding component value of 0.005–1.42;

(c) 1.5–7.5 percent by weight, based on the weight of the emulsion, of at least one hydrophobic nonionic surfactant having an HLB value less than 3; and (d) 1.5–7.5 percent by weight, based on the weight of the emulsion, of at least one hydrophilic nonionic surfactant having an HLB value greater than 10 and soluble in solvent blends having a solvency parameter with a polar component value less than 0.9 or a hydrogen bonding component value less than 1.

2. The composition of claim 1 wherein the hydrophobic surfactant is a poly(oxyethylene)-poly(oxypropylene) block copolymer of the formula

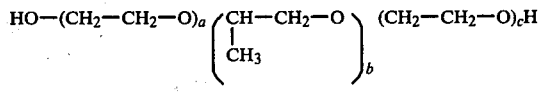

wherein a, b, and c are positive integers and the molecular weight of the poly(oxypropylene) content is between 2750 and 4000.

3. The composition of claim 2 wherein the hydrophilic surfactant is a polyoxyethylated nonylphenol of the formula

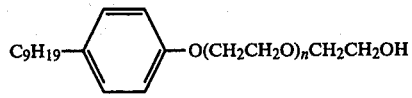

wherein n is a positive integer.

4. The composition of claims 1, 2 or 3 which consists essentially of 75–79 percent by weight of water, 15–17 percent by weight of solvent blend, 1.5–7.5 percent by weight of hydrophobic surfactant, and 1.5–7.5 percent by weight of hydrophilic surfactant.

5. The composition of claim 4 wherein the solvent blend consists essentially of toluene and V.M. & P. naphtha in a 50:50 weight ratio.

* * * * *